United States Patent [19]

Kennedy

[11] 3,954,156

[45] May 4, 1976

[54] LADDER ASSEMBLY

[76] Inventor: Samuel Kennedy, R.R. 1, Mount Albert, Ontario, Canada

[22] Filed: Feb. 26, 1975

[21] Appl. No.: 553,107

[52] U.S. Cl. ..... 182/107
[51] Int. Cl.[2] ..... E06C 5/36
[58] Field of Search ..... 182/107, 108, 145, 150, 182/129, 230

[56] References Cited

UNITED STATES PATENTS

| | | | |
|---|---|---|---|
| 89,686 | 5/1869 | Richardson | 182/145 |
| 235,255 | 12/1880 | King | 182/145 |
| 1,386,195 | 8/1921 | Minnigan | 182/145 |

*Primary Examiner*—Reinaldo P. Machado
*Attorney, Agent, or Firm*—Roy H. Saffrey; Gordon W. Hodson

[57] ABSTRACT

Increased stability is imparted to a ladder according to the present invention by providing a load suspension means connected at the upper and lower ends of the ladder for suspending a load in an elevated position disposed inwardly towards the lower end of the ladder from a vertical plane extending from the point of connection of the suspension at the upper end of the ladder.

2 Claims, 6 Drawing Figures

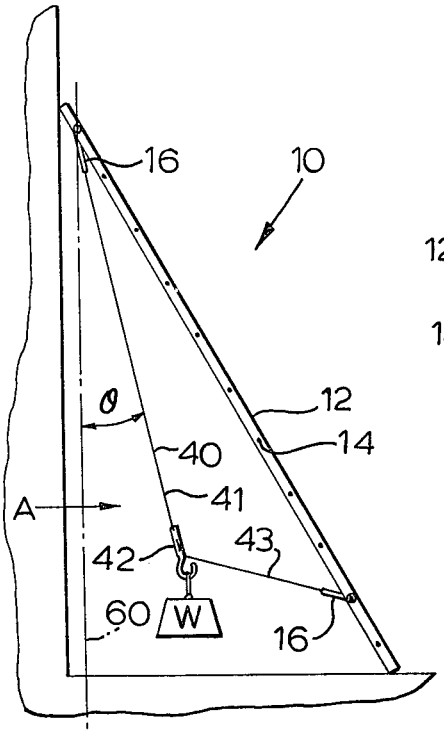
FIG. 1
FIG. 2
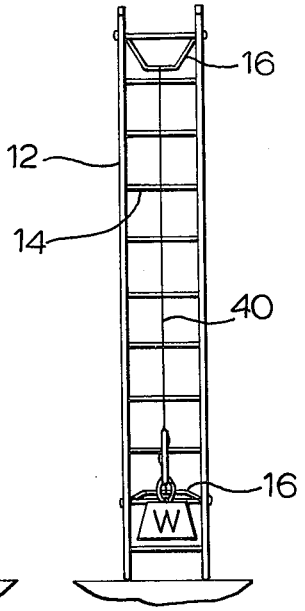
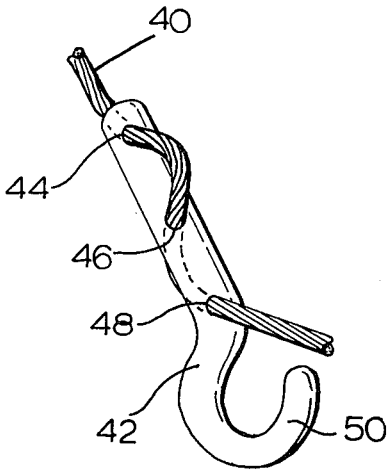
FIG. 3
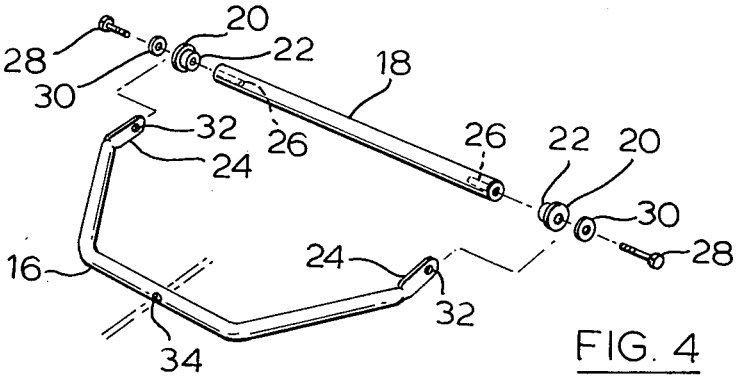
FIG. 4
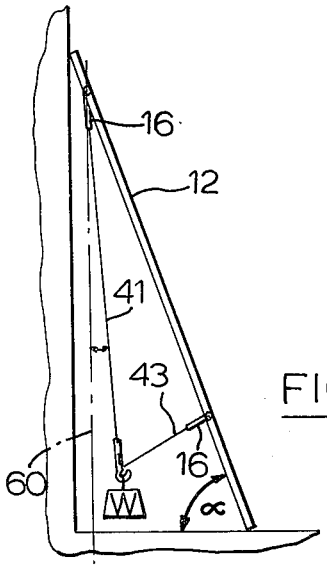
FIG. 6
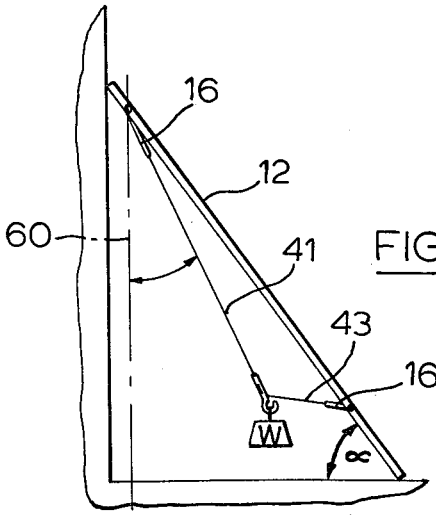
FIG. 5

LADDER ASSEMBLY

FIELD OF INVENTION

This invention relates to ladders of the type which lean against an upright for support in use. In particular this invention relates to a ladder assembly which is more stable than the conventional ladder in use.

PRIOR ART

Difficulty has long been experienced in attempting to stabilize a ladder when in use. When the angle of inclination of a ladder is very steep, it is very easy to move the upper end of the ladder away from the surface on which is rests. Difficulty is experienced under most conditions of use of a ladder in securing the bottom end of the ladder against slippage. This difficulty is multiplied when the angle of inclination of the ladder with respect to the vertical is not steep. Many attempts have been made to provide a secure base at the lower end of the ladder such as by providing feet at the lower end of the ladder which increase the frictional resistance to lateral movement. Despite these proposals it is still common practice to have someone stand on the lower end of the ladder while another person climbs to the top of the ladder.

SUMMARY OF INVENTION

The present invention serves to increase the stability of a ladder in use. According to an embodiment of the present invention a ladder assembly comprises a ladder having an upper end and a lower end and load suspension means connected at the upper end and the lower end of the ladder for suspending a load in an elevated position inwardly from the vertical plane extending from the point of connection of the suspension means at the upper end of the ladder.

PREFERRED EMBODIMENT

The invention will be more clearly understood after reference to the following detailed specification read in conjunction with the drawings wherein FIG. 1 is a side view of a ladder assembly according to an embodiment of the present invention, FIG. 2 is a front view in the direction of arrow A of FIG. 1, FIG. 3 is an enlarged detailed view of the hanger device used to releasably support the load, FIG. 4 is an exploded view of a support bracket for use in connecting the suspension device to the ladder, FIG. 5 is a view similar to FIG. 1 illustrating the load in an alternative position, and FIG. 6 is a view similar to FIG. 5 illustrating the load in a still further position.

With reference to the drawings the reference numeral 10 refers generally to a ladder assembly according to an embodiment of the present invention. The assembly 10 includes a conventional ladder 12 having a plurality of rungs 14. Preferably the rungs 14 are hollow and open at each end. Suspension brackets 16 are mounted adjacent the upper and lower ends of the ladder. In the embodiment illustrated the suspension bracket is mounted by means of an anchor pin 18 which extends through the hollow rungs 14. End plugs 20 have short boss portions 22 which are adapted to fit any close fitting relationship within the open end of the ladder rungs. The ends 24 of the bracket 16 are then located outwardly of the plugs 20. The anchor pin 18 has threaded passages 26 at either end thereof. Threaded screws 28 pass through washers 30, the passages 32 formed in the ends 24 of the bracket 16, the plug 22 and threadably engage the threaded passages 26 in the anchor pin 18 to secure the brackets 16 with respect to the ladder.

A flexible suspension member 40 passes through the passage 34 in each of the mounting brackets 16 so that one end thereof is connected adjacent the upper end of the ladder and the other end thereof is connected to the lower end of the ladder.

The flexible member 40 is preferably in the form of a rope or cord which is simply knotted on passing through the passages 34 to be secured with respect to the bracket 16. It will, however, be understood that the flexible member 40 may be in the form of a rope, a nylon rope, a wire rope or a link chain or the like. A hanger member 42 is mounted on the flexible suspension member 40 as shown in FIG. 3 of the drawings by passing the flexible member 40 through passages 44 and 46 and 48. By reason of the manner in which the hanger member 42 is mounted on the flexible suspension member 40 it is possible to adjust the position of the hanger member longitudinally of the suspension member. Thus, the relative lengths of the first load suspension section 41 and the second load suspension section 43 of the flexible suspension member 40 may be adjusted by moving the hanger member longitudinally of the suspension member 40. The hook shaped member 50 serves to releasably support a weight W in a position beneath the ladder. The weight W may be in any form and may conveniently be in the form of a pail or bucket filled with sand or water.

The load W is preferably releasable with respect to the hanger 42 so that an operator may erect the ladder in a lightweight condition and thereafter apply the load to obtain the required stabilization. Furthermore, it will be apparent that the flexible suspension member 40 may be in the form of a rope which is simply tied about the rungs of the ladder. The suspension bracket 16 has the advantage of locating the suspension cord 40 in a fixed position centrally of the width of the ladder so that the stabilizing load is not laterally off-set and, therefore, tending to tip the ladder from one side to the other. If the cord 40 was merely secured to the rungs of the ladder the operator would tend to move the cord to one side of the center of the ladder to avoid standing on the cord when climbing the ladder and this would result in the load being off-set to one side of the ladder which could be hazardous. The brackets 16 serve to space the ends of the cords a substantial distance from the ladder rungs so that the user does not run the risk of tripping on the cord when climbing the ladder.

As illustrated in FIG. 5 of the drawings the weight W may be moved to a position closely adjacent the lower end of the ladder when the angle of inclination of the ladder is not steep.

As illustrated in FIG. 6 of the drawings the weight W may be moved to a position more closely adjacent the vertical plane 60 when the angle of inclination is steep. It will also be noted that the support bracket 16 may be positioned so that the second length 43 of the cord is downwardly inclined as illustrated in FIG. 6 as opposed to upwardly inclined as illustrated in FIGS. 1 and 5.

It will be noted that the second length 43 of the cord 40 is preferably of a length such that the upper length 41 of the cord 40 is disposed at an angle with respect to the vertical plane 60 passing through the upper rung from which the suspension member depends. By reason of the fact that the load W is suspended from two taut flexible members, it is held relatively stable with respect to the ladder the tension in the lengths 41 and 42 of the cord preventing swinging movement of the weight in a direction towards and away from the vertical wall which supports the ladder in use. If the weight W was merely suspended from one rung of the ladder it would be relatively unstable and it would tend to swing to and fro and if the swing became excessive the load would adversely effect the stability of the ladder.

The stability of the ladder is further enhanced by reason of the fact that the displacement of the load W from the vertical plane provides a horizontal component of the load in a direction towards the wall which serves to increase the resistance to outward movement of the lower end of the ladder with respect to the wall.

From the foregoing it will be apparent that the present invention provides a simple and efficient stable ladder assembly.

Various modifications of the present invention will be apparent to those skilled in the art without departing from the scope of the invention. For example, many of the advantages of the present invention may be achieved in a structure wherein, the hanger device 42 is not slidably mounted with respect to the cable 40. Furthermore, in certain instances the hanger device 42 may be dispensed with and the weight W applied directly to the cord 40. Futhermore, the cord 40 may be in two separate lengths corresponding to the lengths 41 and 43 described above each being separately securable to the load W. The separate lengths of cord may each have a ring at the inner end thereof which may be secured directly to a weight W thereby dispensing with the hanger member 42. It will also be apparent that the suspension means may be adapted to be mounted on a step ladder as opposed to a ladder having rungs by providing an alternative form of a mounting bracket.

These and other modifications of the present invention will be apparent to those skilled in the art.

I claim:

1. A ladder assembly comprising a ladder having an upper end and a lower end, first suspension bracket means mounted adjacent the upper end of said ladder and second suspension bracket means mounted adjacent the lower end of said ladder, flexible cable means having a first end connected to said first suspension bracket and a second end connected to said second suspension bracket, said flexible cable means having a length greater than the length of the ladder extending between said first and second mounting brackets, load support means mounted for movement longitudinally of said flexible cable means, said load support means including means releasably engaging a load, the length of said cable means being less than that required to permit the load to be suspended vertically from the point of connection of the first bracket member with respect to the upper end of the ladder whereby the load is spaced inwardly toward the lower end of the ladder.

2. A ladder assembly comprising a ladder having an upper end and a lower end, flexible cable means having a first end connected to said ladder adjacent the upper end thereof, and a second end connected to the ladder adjacent the lower end thereof, said flexible cable means having a length greater than the length of the ladder extending between said first and second ends, load support means mounted on said flexible cable means, said load support means including means releasably engaging a load, the length of said flexible cable means being less than that required to permit the load to be suspended vertically from the point of connection of the flexible cable means with respect to the upper end of the ladder whereby the load is spaced inwardly toward the lower end of the ladder.

* * * * *